US005803840A

United States Patent [19]

Young

[11] Patent Number: 5,803,840

[45] Date of Patent: Sep. 8, 1998

[54] SOUND PRODUCING BASEBALL BAT

[76] Inventor: Gary Young, P.O. Box 1003, Westwego, La. 70094

[21] Appl. No.: 692,913

[22] Filed: Jul. 26, 1996

Related U.S. Application Data

[63] Continuation-in-part of Ser. No. 512,614, Aug. 8, 1995, Pat. No. 5,590,875.

[51] Int. Cl.[6] ..... A63B 69/36

[52] U.S. Cl. ..... 473/457

[58] Field of Search ..... 473/457, 453, 473/223, 224

[56] References Cited

U.S. PATENT DOCUMENTS

| | | | |
|---|---|---|---|
| 3,226,704 | 12/1965 | Petrash | 473/224 |
| 3,918,721 | 11/1975 | Trask | 473/224 |
| 4,101,132 | 7/1978 | Convey | 473/553 |
| 4,535,980 | 8/1985 | Richards | 473/553 |
| 4,789,160 | 12/1988 | Dollar | 473/224 |
| 4,911,441 | 3/1990 | Brunner | 473/224 |
| 4,971,320 | 11/1990 | Nesbit | 473/553 |
| 5,074,564 | 12/1991 | Rilling | 473/224 |
| 5,082,282 | 1/1992 | Conley | 473/224 |
| 5,131,660 | 7/1992 | Marocco | 473/224 |
| 5,184,826 | 2/1993 | Hall | 473/224 |
| 5,259,620 | 11/1993 | Marocco | 473/224 |
| 5,330,189 | 7/1994 | Reichow | 473/224 |
| 5,395,116 | 3/1995 | Blaakman | 473/224 |
| 5,419,563 | 5/1995 | Abrams | 473/224 |
| 5,435,561 | 7/1995 | Conley | 473/224 |
| 5,588,919 | 12/1996 | Nakamura | 473/224 |

*Primary Examiner*—Theatrice Brown
*Attorney, Agent, or Firm*—Keaty & Keaty

[57] ABSTRACT

The invention relates to baseball equipment, and more particularly to a baseball bat which is provided with an audible signal generating element. A sound module is mounted inside the handle portion and is designed to generate a pre-selected audible signal in the form of a speech sound when a striking portion is oriented above a handle portion. The sound is generated by a sound producing unit which forms a part of a sound module mounted within the handle portion. The sound producing unit is activated by movement of an element within the sound module when the movable element closes the circuit allowing activation of the sound producing unit.

2 Claims, 1 Drawing Sheet

SOUND PRODUCING BASEBALL BAT

CROSS REFERENCE TO RELATED APPLICATION

This application is a continuation-in-part of my application Ser. No. 512,614 filed on Aug. 8, 1995, U.S. Pat. No. 5,590,875 the full disclosure of which is incorporated by reference herein.

BACKGROUND OF THE INVENTION

This invention relates to baseball equipment, and more particularly to a baseball bat which is designed for use by baseball players during training or play. Various games and sports require the use of a bat or club for hitting a ball or a similar object, for example, baseball, one of the most favorite games of the American public, both adults and children. As a sport, baseball attracts millions of spectators who are often loyal supporters of a particular team. During amateur games, children and adults try to emulate movements of their professional baseball players, while fans cheer the players from the stadium seats.

When the baseball game is played by professional players, the weight, size and dimensions of the equipment are strictly regulated. However, the equipment used by non-professionals is often modified to make it more convenient or attractive to the players. For example, various training equipment is modified by incorporating a sound producing member in the bat, so as to produce a hitting sound when the bat strikes a ball. The pitch of the sound can be varied depending on the acceleration of the movement of the bat or club through the air.

The present invention contemplates provision of a baseball bat which can produce various sounds, such as entertaining word signals, while the bat is used by baseball players during training, exercising or just for entertainment.

SUMMARY OF THE INVENTION

It is, therefore, an object of the present invention to provide a baseball bat which can be used in lieu of the conventional baseball equipment.

It is another object of the present invention to provide a baseball bat with a sound module.

It is a further object of the present invention to provide a baseball bat which produces entertaining word signals during manipulation by a player.

It is still a further object of the present invention to provide a baseball bat which can be adapted to appeal to a wide audience of baseball fans.

These and other objects of the present invention are achieved through a provision of a baseball bat device which comprises a handle portion, a striking portion fixedly attached to said handle portion and a sound module mounted within the handle portion. The sound module produces an audible signal in a form of a speech sound which is preselected by the manufacturer.

The sound module comprises a processing unit designed to emulate a human speech and generate a "cheering" sound and slogans when the striking portion is oriented above the handle portion. The sound module is mounted in a housing which is positioned within the handle portion at a location not to interfere with the normal handling of the baseball bat. A movable element moves within the housing and activates the processing unit by contacting at least one contact member mounted in the housing. The contact member is operationally connected to the processing unit to transmit an electrical signal generated by an electrical circuit that is closed when the movable element contacts the contact member.

To enhance the sound produced by the processing unit, one or more speakers are mounted in the housing or in a cap of a handle portion. The sound module is energized by an independent power source, such as one or more batteries mounted within the housing.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
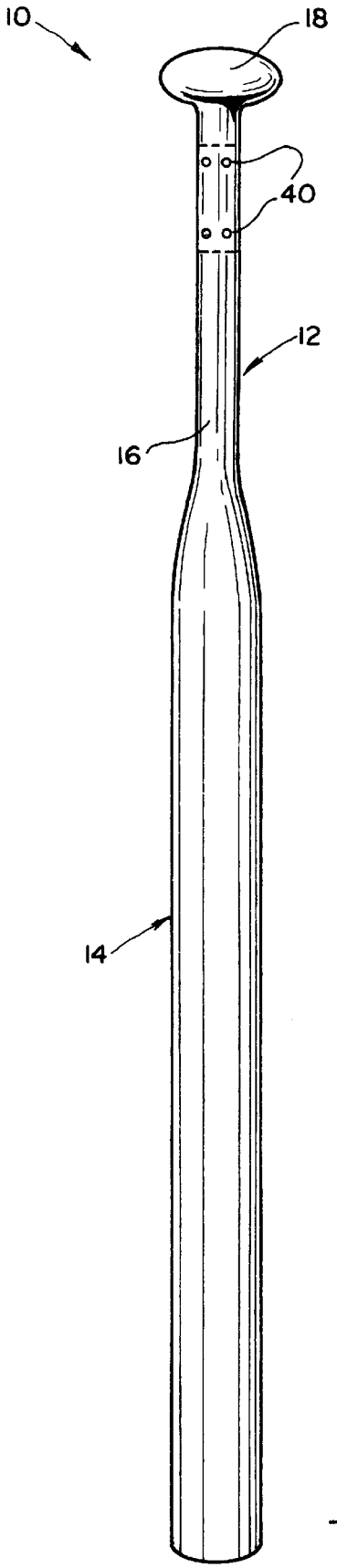
FIG. 1 is a perspective schematic view of a baseball bat in accordance with the present invention.
Figure 2:
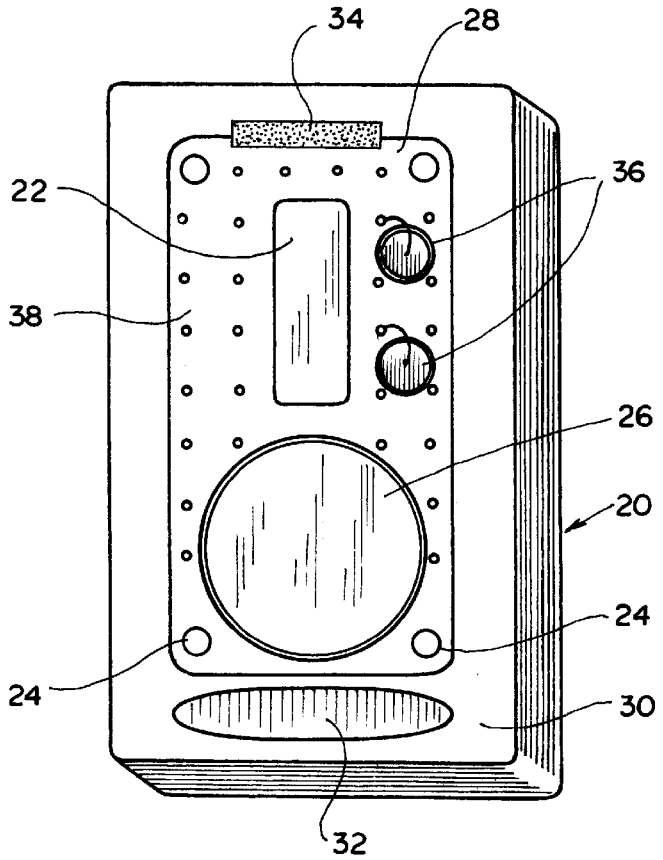
FIG. 2 is a detail view of a sound module utilized with the baseball bat of the present invention.

Referring now the drawings in more detail, FIG. 1 illustrates a baseball bat 10 in accordance with the present invention. The bat 10 comprises a handle portion 12 and a striking portion 14. Conventionally, the handle portion 12 is formed in a generally cylindrical form with a handle body 16 and a handle cap 18. The handle body 16 is formed hollow, at least in a portion thereof, with the internally formed chamber (not shown) being sized to receive a sound module housing 20 therein. As can be better seen in FIG. 2, the housing 20 has a generally rectangular shape, although other shapes, such as oval or round can be suitably employed. The housing 20 is hollow, having the dimensions of the interior chamber large enough to accommodate various details designed to produce an audible signal. Mounted within the housing 20 is a processing unit 22 which comprises an electronic circuit (not shown) that is activated by closing of an electrical circuit as will be described in more detail hereinafter.

The processing unit 22 produces a number of audible signals, such as word, or speech signals selected by the manufacturer. For example, the unit 22 can be designed to produce a cheering sound of a crowd with the words "Go Yankees!" or "Go Tribes!" or other similar words. As will be appreciated by those skilled in the art, the word signals can be modified to accommodate the preference of the fans to produce cheering sounds for the most favorite team. Similarly, word sounds of a different nature, such as "Good Hit!" and others can be produced by the processing unit when the electronic circuit is suitably designed.

One or more contacts 24 are positioned within the housing, the contacts 24 allowing to close the electrical circuit for activation of the processing unit. A movable object, such as a ball 26 is positioned within the housing 20, moving freely within the interior of the housing. The ball 26 is made from an electro-conductive material, similarly to contacts 24, so that when the ball 26 moves to an end 30 of the housing where contacts 24 are located, the ball 26 closes the circuit by touching the contacts 24 and allowing electrical current to move to the processing unit 22. The ball 26 can be formed from any suitable metal, for example steel, and can be additionally plated with a coating of a high conductive material, such as gold.

Once the processing unit 22 is activated, a word or speech signal is produced in accordance with the pre-determined manufacturing design. The word signal can last up to 7 seconds, if desired, allowing a slogan or other cheering messages to be generated and played.

The processing unit 22 is operationally connected by suitable wires (not shown) to a speaker 32 which is mounted within the housing 20 to enhance the sound produced by the processing unit and make it audible through the wall of the housing 20 and the exterior of the handle portion 16. If desired, a speaker can be positioned within the cap 18 and be connected to the processing unit 22 by suitable wiring.

A shock absorbing means, for example a pad 34 made of porous resilient plastic material, is secured in an end 28 of the housing 20. The shock absorbing pad 34 absorbs the force of the movement of the ball 26 when the striking portion 14 is moved into a lowered position to be oriented below the handle portion 12. The pad 34 can extend through the entire width of the housing 20 or can be wide enough to protect the direct area where the ball 26 strikes the end 28 of the housing 20.

The housing 20 also accommodates a power source for the sound module. The power source can be one, or more batteries 36 suitable for energizing the processing 22 and the speaker 32. If desired, a perforated plate 38 can be positioned within the housing 20 to facilitate securing of the necessary electrical circuit and movable object 26 within the housing 20.

The speaker 38 is a suitably dimensioned speaker, for example a mylar speaker having 20 mm in length. Of course, other types of speakers and dimensions of the speaker can be selected depending on the manufacturing requirements and economy of the production.

The housing 20 is secured within the handle portion 16 by conventional means, for example plugs 40 which are inserted in corresponding openings made within the body 16 to securely mount the housing 20 within the handle portion 12. Of course, the position of the housing 20 within the handle body 16 can be varied, so as to make it more convenient for the user to grasp the handle portion 12 without covering the speaker outlet by the user's hands. The housing 20 is preferably made from a lightweight durable material, for example plastic, that would allow easy and inexpensive manufacturing, while protecting the electronic and electrical circuits used in the sound module in accordance with the present invention.

Many changes and modifications can be made in the design of the present invention without departing from the spirit thereof. I, therefore, pray that my rights to the present invention be limited only by the scope of the appended claims.

I claim:

1. A baseball bat device, comprising:

a handle portion;

a striking portion fixedly attached to said handle portion;

a sound module mounted within said handle portion for producing an audible signal in a form of a speech sound, said sound module comprising a housing securely attached to said handle portion, a sound producing unit for generating said audible signal mounted within said housing and a movable object positioned within said housing for activating said sound producing unit when said baseball device is oriented by a player in such a manner that the striking portion is oriented above the handle portion, said sound module further comprising at least one contact member operationally connected to said sound producing unit, said contact member transferring an activation signal to said sound producing unit when said movable object contacts said at least one contact member; and a means for absorbing shock mounted opposite said at least one contact member within said housing.

2. The device of claim 1, wherein said means for absorbing shock comprises a resilient pad secured within said housing and being adapted to be contacted by said movable element, when said movable element moves away from said contact member.

* * * * *